United States Patent [19]

Kobayashi

[11] Patent Number: 4,811,950

[45] Date of Patent: Mar. 14, 1989

[54] GOLF CLUB HEAD

[75] Inventor: Masashi Kobayashi, Matsudo, Japan

[73] Assignee: Maruman Golf Co., Ltd., Tokyo, Japan

[21] Appl. No.: 77,929

[22] Filed: Jul. 27, 1987

[30] Foreign Application Priority Data

Jul. 31, 1986 [JP] Japan ..... 61-178923

[51] Int. Cl.[4] ..... A63B 53/04

[52] U.S. Cl. ..... 273/171; 273/172; 273/174

[58] Field of Search ..... 273/78, 171, 172, 173, 273/174, 167 R, 167 F, 168, 169, 170

[56] References Cited

U.S. PATENT DOCUMENTS

| | | | |
|---|---|---|---|
| 2,360,364 | 10/1944 | Reach | 273/171 |
| 3,941,390 | 3/1976 | Hussey | 273/171 |
| 4,052,075 | 10/1977 | Daly | 273/171 |
| 4,728,105 | 3/1988 | Kobayashi | 273/169 |

FOREIGN PATENT DOCUMENTS

| | | | |
|---|---|---|---|
| 60-2566 | 1/1985 | Japan . | |
| 60-43356 | 3/1985 | Japan . | |
| 60-55464 | 4/1985 | Japan . | |
| 60-104165 | 7/1985 | Japan . | |
| 61-21570 | 2/1986 | Japan . | |
| 61-240978 | 10/1986 | Japan . | |
| 9862 | of 1906 | United Kingdom | 273/78 |

*Primary Examiner*—George J. Marlo

*Attorney, Agent, or Firm*—Armstrong, Nikaido, Marmelstein & Kubovcik

[57] ABSTRACT

A head of a golf club comprises a head body having a front surface forming a hitting surface of the head for hitting a ball and a cut-off portion other than the front surface. A fitting member for adjusting at least the weight or weight-distribution of the head is made of a material different from that of the head body and fixed to the cut-off portion of the head body so as to form a part of the outer surface of the head other than the hitting surface thereof. A cushion member made of a resilient material is disposed between the head body and the fitting member, to prevent damage to the head body and separation of the fitting member from the head body caused by an impact force produced when a golf ball is hit by the golf club head.

11 Claims, 3 Drawing Sheets

GOLF CLUB HEAD

BACKGROUND OF THE INVENTION

1. Field of the Invention

The present invention relates to a head of a golf club and, more particularly, to an improvement of a head of a golf club having a head body and a fitting member made of a material different from that of the head body and fixed to the head body to adjust at least the weight or weight-distribution of the head.

2. Description of the Related Arts

A head of a golf club of iron or wood type comprising a head body and a fitting member such as a back plate, side metal, or sole plate by which at least the weight or weight-distribution of the head is adjusted, is known, and the fitting member in the conventional head of a golf club is made of a material different from that of the head body and secured to a mounting surface of the head body by an adhesive or screws.

In such a conventional head of a golf club, a concentration of stress occurs at the mounting surface of the head body, and a stress caused by a difference in the strains produced in the head body and the fitting member is produced at the boundary of the head body and the fitting member when a ball is hit by the head, due to a difference of hardness, strength or resiliency of the head body and the fitting member due to a difference of the materials thereof. Accordingly, a conventional head of a golf club has a disadvantage in that a crack causing damage to the head body can occur in the mounting surface of the head body and the fitting member thus separated from the head body.

SUMMARY OF THE INVENTION

An object of the present invention is to provide a head of a golf club comprising a head body and a fitting member made of a material different from that of the head body and fixed to the head body so that at least the weight or weight-distribution of the head can be adjusted and able to prevent damage to the head body and separation of the fitting member from the head body.

According to the present invention, there is provided a head of a golf club comprising: a head body having a front surface forming a hitting surface of the head for hitting a ball; a fitting member for adjusting at least the weight or weight-distribution of the head, the fitting member being made of a material different from that of the head body and fixed to the head body so as to form a part of an outer surface of the head other than the hitting surface thereof; and a cushion member made of a resilient material and disposed between the head body and the fitting member.

In the head of the golf club, according to the present invention, the cushion member can absorb either an impact energy between the head body and the fitting member or a stress produced due to a difference in the strains produced in both the head body and the fitting member when a ball is hit by the head body. Accordingly, damage to the head body and separation of the fitting member from the head body can be prevented.

DESCRIPTION OF THE PREFERRED EMBODIMENTS

Figure 1:
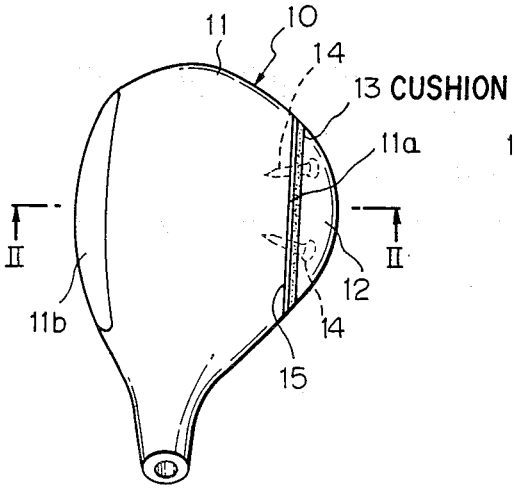
FIG. 1 is a plane view of a head of a wood golf club illustrating a first embodiment of the present invention.
Figure 2:
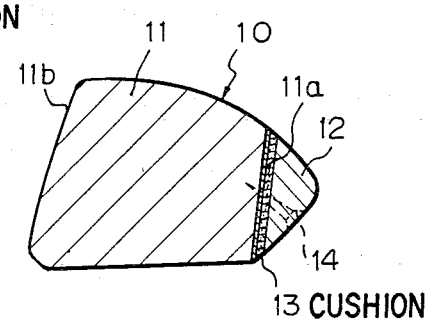
FIG. 2 is a cross-sectional view of the wood golf club head taken along the line II—II in FIG. 1.

FIGS. 1 and 2 illustrate a first embodiment of the present invention applied to a head of a wood golf club. Referring to FIGS. 1 and 2, the head 10 comprises a head body 11 having a front surface 11*b* forming a hitting surface of the head 10 for hitting a golf ball. The back of the head body 11 is provided with a cut-off surface 11*a* for mounting thereon a fitting member or side metal 12 having an outer surface complementary to the back of the head body 11 and forming a back surface of the head 10 therewith. The side metal 12 is used to adjust the weight of the head 10 and the distance of a center of gravity of the head 10 from the hitting surface thereof.

A cushion member or sheet 13 having a substantially constant thickness is disposed between the cut-off surface 11*a* of the head body 11 and the side metal 12. The cushion sheet 13 is laid on the whole of the cut-off surface 11*a* of the head body 11 and fixed to the head body 11 by an adhesive 15. The side metal 12 is laid on the cushion sheet 13 and fixed to the head body 11 by screws 14 which are screwed into the head body 11 through the side metal 12 and the cushion sheet 13.

Since the side metal 12 is fixed to the head body 11 through the cushion sheet 13 by only the screws 14, it is easily removed from the head body 11 and exchanged for a different side metal 12 to change the center of gravity of the head 10. However, the side metal 12 may be permanently fixed to the head body 11 through the cushion sheet 13 by using an adhesive between the side metal 12 and the cushion sheet 13. Further, the side metal 12 and the cushion sheet 13 may be fixed to the head body 11 by only an adhesive, the screws 14, or the like.

The head body 11 of the wood golf club head 10 can be made of a wood such as a persimmon, maple, or plywood, a fiber-reinforced plastic reinforced by carbon fibers, glass fibers or the like, an aluminium alloy, a titanium alloy, or a fiber-reinforced metal, etc., and although not shown in FIGS. 1 and 2, the head body 11 may have a hollow structure. The side metal 12 as a fitting member is made of a material different from that of the head body 11. Preferably, the side metal 12 is made of a material having a specific gravity greater than that of the head body 11, for example, a stainless steel, brass, iron, or tungsten. The distance of the center of gravity of the head 10 from the hitting surface thereof can be adjusted by ensuring that the material selected for the side metal 12 has a desired specific gravity. Further, the cushion sheet 13 is made of a resilient material having an impact-energy-absorbing characteristic, for example, a rubber, resin reinforced by aramid fibers, ABS resin, urethane resin, or silicone resin.

When a ball is hit by the head 10 having the above-mentioned structure, the cushion member 13 absorbs or alleviates either an impact energy between the head body 11 and the side metal 12 or a stress produced due to a difference in strain produced in both the head body 11 and the side metal 12. Accordingly, damage to the head body 11 caused by a concentration of stress, and separation of the side metal 12 from the head body 11, can be prevented.

Figure 3:
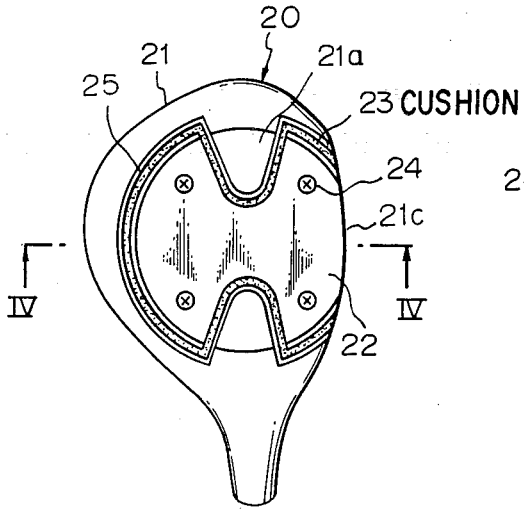
FIG. 3 is a bottom view of a head of a wood golf club illustrating a second embodiment of the present invention.
Figure 4:
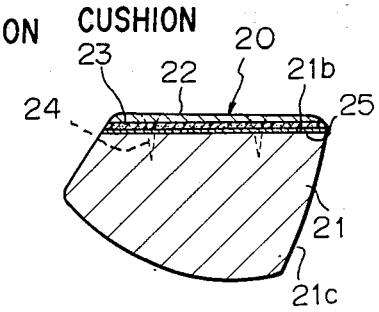
FIG. 4 is a cross-sectional view of the wood golf club head taken along the line IV–IV in FIG. 3.

FIGS. 3 and 4 illustrate a second embodiment of the present invention applied to a head of a wood golf club. Referring to FIGS. 3 and 4, a head 20 comprises a head body 21 having a front surface 21*c* forming a hitting surface of the head 20. The head body 21 also has a sole surface 21*a*. formed with a concavity 21*b* for receiving a fitting member or sole plate 22 having an outer surface complementary to the sole surface of the head body 21 and forming a sole surface of the head 20. The head body 21 can be made of the same material as that of the head body of the above-mentioned first embodiment, and the sole plate 22 made of a material having a specific gravity greater than that of the head body 21 and a hardness greater than that of the head body 21. Accordingly, the sole plate 22 serves to lower the position of a center of gravity of the head 20 and to prevent damage to the sole surface of the head 20.

A cushion member or sheet 23 having a substantially constant thickness is disposed between the concavity 21*b* of the head body 21 and the sole plate 22 in the whole of the boundary of the head body 21 with the sole plate 22. The cushion sheet 23 is fixed to the head body 21 by an adhesive 25, and the side metal 22 is laid on the cushion sheet 23 and fixed to the head body 21 by screws 24 which are screwed into the head body 21 through the sole plate 22 and the cushion sheet 23. The cushion sheet 23 can be made of the same material as that of the cushion sheet in the first embodiment.

Since the sole member 22 is fixed to the head body 21 through the cushion sheet 23 by only screws 24, it is easily removed from the head body 21 and exchanged for a different sole member 22 to change the position of the center of gravity of the head 10 with regard to the sole surface of the head 20. However, the sole plate 22 may be permanently fixed to the head body 21 through the cushion sheet 23 by using an adhesive therebetween. Further, the sole plate 22 and the cushion sheet 23 may be fixed to the head body 21 by only an adhesive, the screws 24, or the like.

The cushion sheet 23 of the second embodiment can provide the same effects as those of the cushion sheet of the first embodiment.

Figure 5:
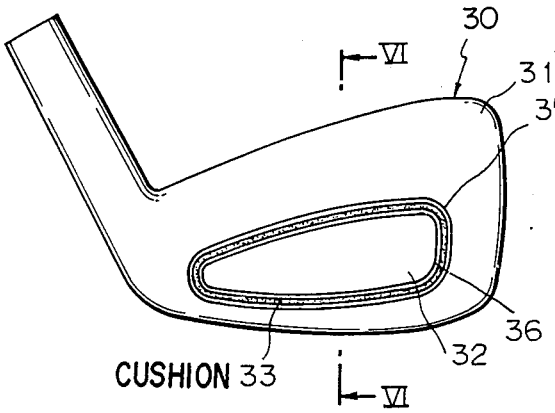
FIG. 5 is a view of a head of an iron golf club illustrating a third embodiment of the present invention.
Figure 6:
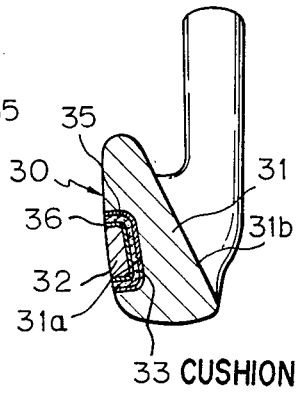
FIG. 6 is a cross-sectional view of the iron golf club head taken along the line VI–VI in FIG. 5.

FIGS. 5 and 6 illustrate a third embodiment of the present invention applied to a head of an iron golf club. Referring to FIGS. 5 and 6, the head 30 comprises a head body 31 having a front surface 31*b* forming a hitting surface of the head 30 and having a concavity 31*a* formed at the back thereof for receiving a fitting member or back plate 32. The back plate 32 has an outer surface complementary with the back of the head body 31 and forming a back surface of the head 20. The back plate 32 is used to adjust the distance of the center of gravity of the head 30 from the hitting surface thereof and to adjust the repellent effect of the head 30 on a ball when the ball is hit by the head 30.

A cushion member or sheet 33 having a substantially constant thickness is disposed between the concavity 31*a* of the head body 31 and the back plate 32. The cushion sheet 33 is laid on the whole of the concavity 31*a* of the head body 31 and fixed to the head body 31 by an adhesive 35, and the back plate 32 is fixed to the cushion sheet 33 by an adhesive 36.

The head body 31 of the iron golf club head 30 can be made of a fiber-reinforced plastic reinforced by carbon fibers, glass fibers or the like, an aluminium alloy, a titanium alloy, or a fiber-reinforced metal, etc., and although not shown in FIGS. 5 and 6, the head body 31 may have a hollow structure. The back plate 32 as a fitting member is made of a material different from that of the head body 31, for example, a stainless steel, brass, iron, or tungsten. The distance of the center of gravity of the head 10 from the hitting surface thereof can be adjusted by selecting a material having a desired specific gravity for the back plate 32. Further, the cushion sheet 33 is made of a resilient material having an impact-energy-absorbing characteristic, for example, a rubber, resin reinforced by aramid fibers, ABS resin, urethane resin, or silicone resin.

The cushion sheet 33 of the third embodiment can provide the same effects as those of the cushion sheet of the first embodiment.

Although the cushion sheet 33 and the back plate 32 in the third embodiment are fitted into the concavity 31*a* of the head body 31, the back plate 32 may be attached to the back of the head body 31 through the cushion sheet 33 without the provision of a concavity on the back of the head 31. Further, the back plate 32 may have a variable shape or size.

Figure 7:
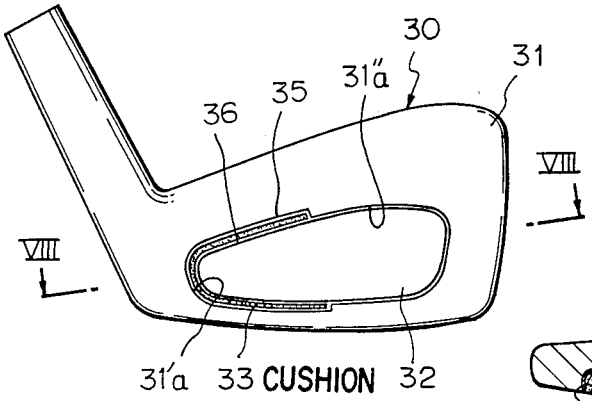
FIG. 7 is a view of a head of an iron golf club illustrating a fourth embodiment of the present invention.
Figure 8:
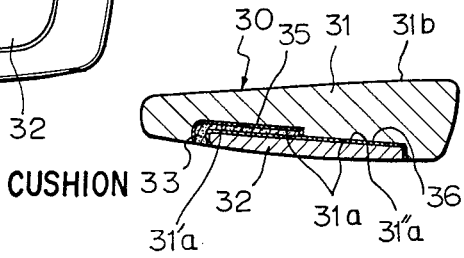
FIG. 8 is a cross-sectional view of the iron golf club head taken along the line VIII—VIII in FIG. 7.

FIGS. 7 and 8 illustrate a fourth embodiment of the present invention applied to a head of an iron golf club. In FIGS. 7 and 8, the same or similar constituent elements as those in the third embodiment are denoted by the same reference numerals as used in FIGS. 5 and 6.

In the fourth embodiment, the concavity 31*a* formed in the back of the head body 31 consists of a first section 31*a*′ located closer to the heel end of the head body 31 and a second section 31*a*″ located closer to the toe end of the head body 31. The first section 31*a*′ of the concavity 31*a* has a greater contour and depth than those of the second section 31*a*″, respectively. The cushion sheet 33 is laid only on the first section 31*a*′ of the concavity and fixed to the head body 31 by an adhesive 35. The back plate 32 is laid on both the cushion sheet 33 and the second section 31*a*″ of the concavity 31*a* and fixed to the cushion sheet 33 and the head body 31 by an adhesive 36. The remaining construction of the head 30 is substantially the same as that of the third embodiment.

Generally, when a golf ball is hit by the head 30, a strong stress is concentrated in the vicinity of the heel end of the head 30, since the head 30 is connected at the heel end thereof to a club shaft and the head 30 is forced to move forward by the force of inertia exerted thereon. Therefore, cracks are apt to occur at the boundary of the head body 31 with the back plate 32, particularly in a part of the boundary located close to the heel end of the head 30. However, in the fourth embodiment, the cushion sheet 33 is located on a part of the concavity 31*a* where cracks are apt to occur, and thus the damaged to the head body 31 can be effectively prevented by a very small cushion sheet 33.

Figure 9:
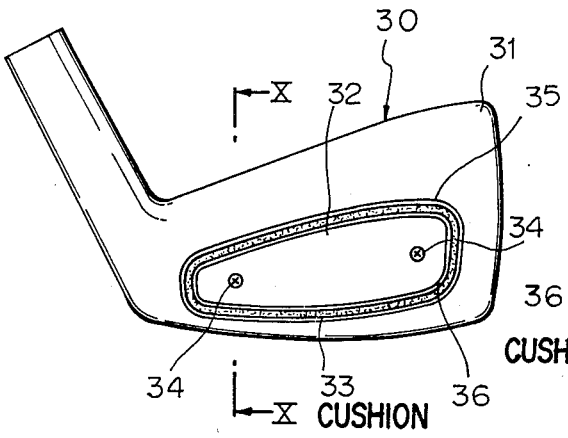
FIG. 9 is a back view of a head of an iron golf club illustrating a fifth embodiment of the present invention.
Figure 10:
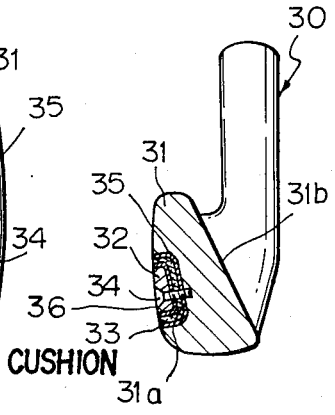
FIG. 10 is a cross-sectional view of the iron golf club head taken along the line X—X in FIG. 9.

FIGS. 9 and 10 illustrate a fifth embodiment of the present invention applied to a head of an iron golf club. In FIGS. 9 and 10, the same or similar constituent elements as those in the third embodiment are denoted by the same reference numerals as those used in FIGS. 5 and 6.

In the fifth embodiment, the cushion sheet 33 is located on the whole of the inner surface of the concavity 31*a* of the head body 31 and fixed to the head body 31 by an adhesive 35, while the back plate 32 is fixed to the cushion sheet 33 by an adhesive 36. Further, the back plate 32 is fixed to the head body 31 through the cushion sheet 33 by screws 34 screwed into the head body 31 through the back plate 32 and the cushion sheet 33. The remaining construction of the head 30 is substantially the same as that of the third embodiment.

The head 30 of the fifth embodiment can obtain substantially the same effect as that obtained by the third embodiment.

Although particular embodiments of the present invention as illustrated in the drawings have been described, it will be understood, of course, that the present invention is not limited thereto, since modifications can be easily made by those skilled in the art in the light of the foregoing teaching. For example, the back plate of the fifth embodiment may be fixed to the head body through the cushion sheet only by screws or another mechanical fixing means. Further, a plurality of fitting members, such as side metals, sole plates, or back plates may be fixed to the head body through a corresponding cushion sheet. Furthermore, the present invention may be applied to a putter head.

I claim:

1. A head of golf club comprising:

a head body having a front surface forming a hitting surface of said head for hitting a ball, said head body also having a cut-off surface other than said front surface;

a fitting member for adjusting a least the weight of said head, said fitting member being engagable with said cut-off surface of said head body to form an outer surface portion continuous with said head body but other than said front surface thereof, said fitting member being made of a material different from that of said head body;

a cushion member made of a resilient material and disposed along an entire contact area between said cut-off surface of said head body and said fitting member; and means for securing said head body, cushion member and fitting member so as to form an integral club head.

2. A head of a golf club according to claim 1, wherein said head body has a cut-off surface formed at the back thereof, and said fitting member is made of metal and is fixed to said cut-off surface of said head body through said cushion member.

3. Ahead of a golf club according to claim 1, wherein said head body has a concavity formed at the sole thereof, and said fitting member is sole plate fitted into said concavity of said head body through said cushion member and fixed to said head body through said cushion member.

4. A head of golf bulb according to claim 2 or 3, wherein said head body has a shape similar to that of a conventional wood golf club head.

5. A head of a golf club according to claim I, wherein said head body has a concavity formed at the back thereof, and said fitting member is a back plate fitted into said concavity of said head body through said cushion member and fixed to said head body through said cushion member.

6. A head of golf club according to claim 5, wherein said head body has a shape similar to that of a conventional iron golf club head.

7. A head of a golf club according to claim 1, wherein said fitting member has a specific gravity which is greater than that of said head body.

8. A head of a golf club according to claim 1, wherein said cushion member is made of a silicon or urethane rubber, or fiber-reinforced resin reinforced by aramid fibers.

9. A head of a golf club according to claim 1, wherein said cushion member is fixed to said head body by an adhesive, and said fitting member is detachably fixed to said head body through said cushion member by screws extending through said fitting member and said cushion member and screwed into said head body.

10. A head of a golf club according to claim 1, wherein said fitting member and said cushion member are fixed to said head body by an adhesive.

11. A head of a golf club according to claim 1, wherein said cushion member is fixed to said head body by an adhesive, and said fitting member is fixed to said cushion member by an adhesive and also fixed to said head body through said cushion member by screws extending through said fitting member and said cushion member and screwed into said head body.

* * * * *